US005403209A

United States Patent [19]

Lytle

[11] Patent Number: 5,403,209

[45] Date of Patent: Apr. 4, 1995

[54] ELECTRICAL CONNECTOR HAVING UNIFORM CONTACT RECEIVING SLOTS

[75] Inventor: Thomas G. Lytle, Danbury, Conn.

[73] Assignee: Burndy Corporation, Norwalk, Conn.

[21] Appl. No.: 104,019

[22] Filed: Aug. 9, 1993

[51] Int. Cl.[6] ..... H01R 13/10

[52] U.S. Cl. ..... 439/682; 439/751

[58] Field of Search ..... 439/630–637, 439/78–83, 682, 862, 873, 733

[56] References Cited

U.S. PATENT DOCUMENTS

| | | | |
|---|---|---|---|
| 3,740,699 | 6/1973 | Johnson et al. | 439/637 |
| 3,783,433 | 1/1974 | Kurtz et al. | 439/637 |
| 3,862,792 | 11/1975 | Fayne | 439/733 |
| 4,017,143 | 4/1977 | Knowles | 439/637 |
| 4,118,715 | 2/1980 | Ammon et al. | 29/629 |
| 4,220,393 | 9/1980 | Ammon et al. | 439/682 |
| 4,274,699 | 6/1981 | Keim | 439/637 |
| 4,717,354 | 1/1988 | McCleevey | 439/733 |
| 4,966,557 | 10/1990 | Barkus et al. | 439/246 |
| 5,131,872 | 7/1992 | Consoli et al. | 439/751 |
| 5,171,154 | 12/1992 | Casciotti et al. | 439/67 |

*Primary Examiner*—Daniel W. Howell
*Assistant Examiner*—Hien D. Vu
*Attorney, Agent, or Firm*—Perman & Green

[57] ABSTRACT

An electrical connector has a housing and spring contacts. The housing has uniform straight, cross-sectional T-shaped contact receiving slots. The spring contacts have middle sections fixedly mounted to the housing in head sections of the T-shaped slots and top sections. The top sections have contact areas deflectably located in base sections of the T-shaped slots and pre-load tabs movably confined in the head sections of the T-shaped slots.

12 Claims, 2 Drawing Sheets

ELECTRICAL CONNECTOR HAVING UNIFORM CONTACT RECEIVING SLOTS

BACKGROUND OF THE INVENTION

1. Field of the Invention

The present invention relates to electrical connectors and, more particularly, to a new configuration of connecting electrical contacts to a housing that form the electrical connector.

2. Prior Art

U.S. Pat. No. 4,017,143 discloses electrical contacts that are press-fit into a housing. The contacts have upper tabs, contact bowed sections, a tail section, and a widened middle section. U.S. Pat. No. 5,131,872 discloses an electrical contact having a positioning U-shaped portion and an extension portion at its middle. U.S. Pat. No. 4,966,557 discloses an electrical contact with a U-shaped retention section. U.S. Pat. Nos. 4,188,715 and 5,171,154 show other types of electrical connectors.

SUMMARY OF THE INVENTION

In accordance with one embodiment of the present invention an electrical connector is provided comprising a housing and a plurality of spring contacts. The housing has a plurality of contact receiving slots. At least some of these slots extend entirely through the housing with a uniform straight, general cross-sectional T-shape. Each of the T-shaped slots have a head section and a base section that form the general T-shape. The spring contacts are one piece contacts fixedly connected to the housing in the T-shaped slots. Each contact has a middle section located in the head section of one of the T-shaped slots with retention arms extending from opposite sides of the middle section across the height of the head section to fixedly mount the middle section in the head section. Each contact also has a top section with a contact area deflectably located in the base section and a pre-load tab movably located in the head section.

In accordance with another embodiment of the present invention, an electrical connector is provided comprising a housing and spring contacts fixedly connected to the housing. The housing has straight, cross-sectional T-shaped slots extending from a top of the housing to a bottom of the housing. The spring contacts are fixedly connected in the T-shaped slots. The contacts each have a bottom contact section extending from the bottom of the housing, a middle section fixedly connected to the housing in a head section of one of the T-shaped slots and a top contact section movably located in the T-shaped slot.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
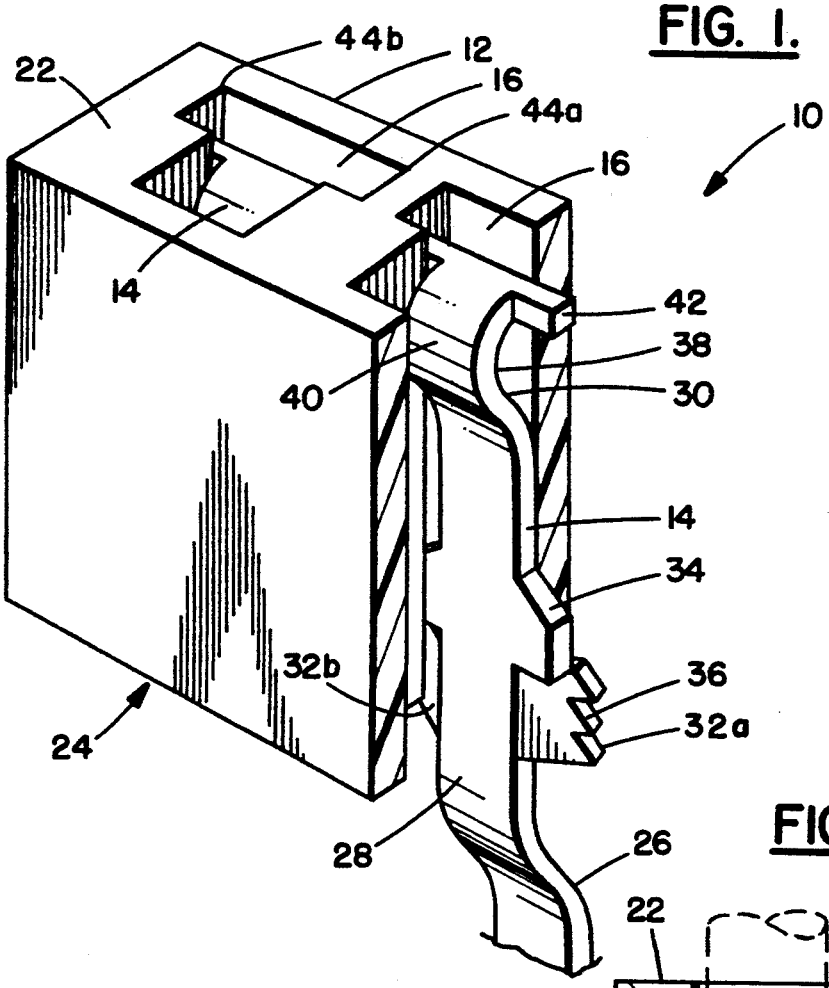
FIG. 1 is a perspective sectional view of an electrical connector incorporating features of the present invention.

Referring to all of the figures in the drawings, there is shown an electrical connector 10 incorporating features of the present invention. Although the present invention will be described with reference to the single embodiment shown in the drawings, it should be understood that the present invention can be embodied in various different types and kinds of alternate embodiments. In addition, any suitable size, shape or type of elements or materials could be used.

Figure 2:
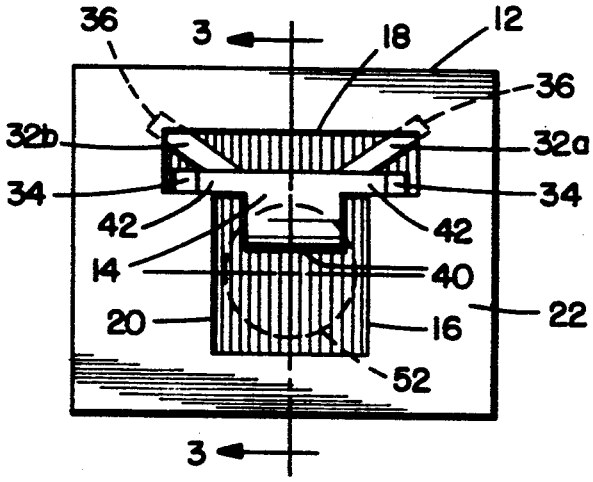
FIG. 2 is a top plan view of a section of the connector shown in FIG. 1.

The connector 10 generally comprises a housing 12 and electrical contacts 14. The housing 12 is made of a dielectric material, such as a molded plastic or polymer material. The housing 12 has a plurality of contact receiving slots 16. The slots 16 extend entirely through the housing 12 with a uniform straight general cross-sectional T-shape as seen best with reference to the plan top view shown in FIG. 2. Each slot 16 is comprised of a head section 18 and a base section 20 that combine to form the general T-shape. The housing 12 entirely encloses the T-shaped slots 16 except at a top surface 22 and a bottom surface 24 of the housing. The embodiment shown shows the housing 12 as having only T-shaped slots 16. However, in alternate embodiments, the housing could also include other types of contact receiving areas as well as other types of contacts.

The electrical contacts 14 are comprised of electrically conductive material, such as metal, and include a bottom section 26, a middle section 28, and a top section 30. It should be understood that use of language, such as "top", "middle" and "bottom", is for reference only. The contacts 14 are preferably made from a sheet of metal that is cut and stamped to form a series of the contacts 14 on a carry strip. The contacts 14 are then preferably inserted into the receiving slots 16 from the bottom of the housing 12. The carry strip is then removed to complete assembly of the connector. The bottom section 26 is adapted to make electrical contact with a printed circuit board such as by a through-hole or surface mounting technique. The middle section 28 includes two retention arms 32*a*, 32*b* extending from opposite sides of the middle section and a broad section 34. The broad section 34 has a width larger than the width of the base section 20. The retention arms 32*a*, 32*b* extend from the middle section at angles of about 45 degrees. The ends 36 of the retention arms 32*a*, 32*b* are serrated or barbed. In alternate embodiments the ends 36 need not have multiple serrations or barbs. The top section 30 includes a bight or bend 38 having a contact area 40 and two preload tabs 42.

Each of the contacts 14 is fixedly mounted in one of the slots 16. The bottom section 26 extends from the bottom of the housing. The middle 28 is fixedly held in the head section 18 of the slot. The broad section 34 is wider than the width of the base section 20 to prevent the middle section 28 from entering the base section 20. The side ends of the broad section 34 are located against the housing at a junction 46 of the head section 18 to the base section 20. The retention arms 32*a*, 32*b* extend across the height of the head section 18 into the distal corners 44*a*, 44*b* of the head section. The retention arms are pressed into the housing to form an interference fit. The serrated ends 36 pierce into the housing and are held in place by the broad section's contact with the housing at the junction 46.

The top sections 30 of the contacts 14 are deflectably located in both the head and base sections 18,20 of the slots 16. Each of the bights 38 extend from one of the middle sections 28 in the head section 18 of the housing slots, into one of the base sections 20, and back into the head section 18 proximate the top of the slot 16. The preload tabs 42 extend from the sides of the top section 30 at the top of the contacts 14 such that the width of the top section at the preload tabs 42 is wider than the width of the base section 20. The preload tabs 42 are preloaded against the housing 12 in the head section 18 at the junction 46. A space 48 is provided between the back 49 of the top of the contacts and the distal wall 50 of the head section 18. This space 48 is provided to allow the top sections 30 to be able to deflect back into the head sections 18 when a male contact 52 of a second connector is inserted into the base section 20 of each slot 16 through the open tops of the slots.

As the male contacts 52 are inserted into the slots 16, they encounter the contact areas 40 of the bights 38. Further insertion of the male contacts 52 causes the top sections 30 of the contacts to be deflected out of the base sections 20, at least partially, back towards the distal wall 50. The top section 30 deflects in a cantilever fashion; the middle section 28 remaining substantially stationary in the housing. The space 48 provides clearance for this deflection. The present invention, by using a straight uniform T-shaped slot in the connector housing provides positioning and guidance for the contacts 14 during assembly. In addition, the bottom surface of the broad section 34 can be used as a seat to press the contact 14 into the housing 12 during assembly. This helps to ensure a straight insertion. The broad section 34 is a close fit in the head section 18 to provide stability and prevent cocking of the contact 14 in the base section 20. The shape of the slot also provides an accurate retention surface in the corners 44*a*, 44*b* and at junction 46 for securing the contacts 14 in the housing 12. It also provides a preload shelf for the contacts 14 with room for deflection of the contact. All of these features are accomplished with the unique, but simple straight T-shaped contact receiving slots and contacts described above.

Figure 3:
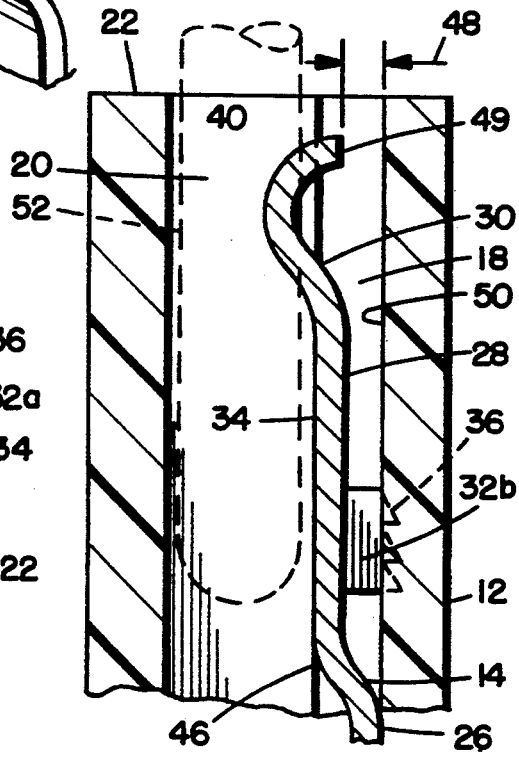
FIG. 3 is a sectional view of the connector shown in FIG. 2 taken along line 3—3.
Figure 4:
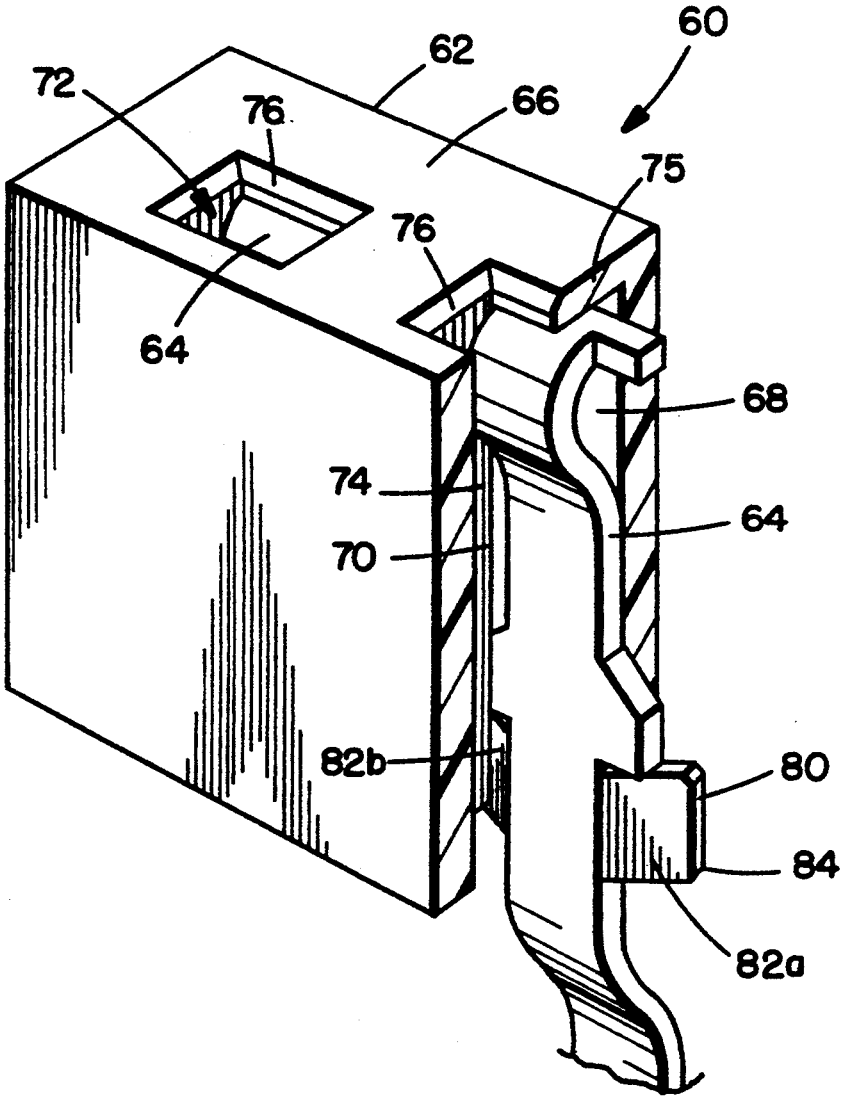
FIG. 4 is a perspective sectional view of an alternate embodiment of the present invention.

Referring now to FIG. 4, an alternate embodiment of an electrical connector is shown. The connector 60 has a housing 62 and electrical contacts 64. The housing 62 is substantially similar to the housing 12 of the connector 10 shown in FIGS. 1–3 with two exceptions. First, the housing 62 has a top surface 66 that covers the top of the head section 68 of the T-shaped slots 70 at area 75. Thus, apertures 72 into the top surface 66 only extend directly into the base sections 74 of the slots 70. This type of embodiment helps to properly position the contacts 64 longitudinally in the slots 70 to help prevent any misalignment of the pin contacts 52 (see FIGS. 2 and 3) in the slots 70. The edges 76 of the apertures 72 are also bevelled to facilitate alignment of the pin contacts 52 into the base sections 74. Although the top of the head section 68 is enclosed, the slots 70 still have a uniform straight general cross-sectional T-shape that extends substantially entirely through the housing 62 except for the top of the head section 68. The contacts 64 are substantially the same as the contacts 14 shown in FIGS. 1–3 except for the ends 80 of the retention arms 82*a*, 82*b*. In this embodiment, the ends 80 do not have barbs or serrations. Rather, the bottom 84 of the ends 80 function as a barb or serration to help retain the contacts in the housing 62.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. An electrical connector comprising:

a housing having a plurality of contact receiving slots, at least some of the slots extending entirely through the housing with a uniform straight general cross-sectional T-shape along the entire length of each slot, each of the T-shaped slots having a head section and a base section that form the general T-shape; and a plurality of one-piece spring contacts fixedly connected to the housing in the T-shaped slots, each contact having a middle section located in the head section of one of the T-shaped slots with retention arms extending from opposite sides of the middle section across the height of the head section to fixedly mount the middle section in the head section, and a top section having a contact area deflectably located in the base section and a pre-load tab movably located in the head section.

2. A connector as in claim 1 wherein the housing entirely encloses the T-shaped slots except at a top surface and at a bottom surface of the housing.

3. A connector as in claim 1 wherein ends of the retention arms are pressed into the housing to form an interference fit.

4. A connector as in claim 1 wherein the middle section includes a broad section that is wider than the width of the base section to prevent the middle section from entering the base section.

5. A connector as in claim 1 wherein the top section has two pre-load tabs extending inside the head section past opposite sides of the base section such that the pre-load tabs limit the location of the contact area inside the base section.

6. An electrical connector comprising:

a housing having straight, cross-sectional T-shaped slots extending uniformly from a top of the housing to a bottom of the housing; and spring contacts fixedly connected to the housing in the T-shaped slots, the contacts each having a bottom contact section extending from the bottom of the housing, a middle section fixedly connected to the housing in a head section of one of the T-shaped slots, and a top contact section movably located entirely within the T-shaped slot. Please add the following claim:

7. A connector as in claim 6 wherein the housing entirely encloses the T-shaped slots except at a top surface and a bottom surface of the housing.

8. A connector as in claim 6 wherein the middle section includes a broad section and retention arms, the broad section being located against the housing adjacent a base section of the T-shaped slot at a junction of the head section to the base section.

9. A connector as in claim 8 wherein the broad section is wider than the base section and the retention arms extend entirely across the height of the head section.

10. A connector as in claim 9 wherein the retention arms pierce into the housing at corners of the head section distal from the base section.

11. A connector as in claim 10 wherein the retention arms extend from the rest of the middle section at angles of about 45°.

12. A connector as in claim 6 wherein the top section has a contact area deflectably located in a base section of the T-shaped slot and pre-load tabs deflectably located in the head section, the pre-load tabs contacting the housing at a junction of the base section with the head section to limit the location of the contact area in the base section.

* * * * *